US005419675A

United States Patent [19]

Hein

[11] Patent Number: 5,419,675

[45] Date of Patent: May 30, 1995

[54] DEVICE FOR TILTING ROLLED STOCK

[75] Inventor: Otto Hein, Steyr, Austria

[73] Assignee: GFM Gesellschaft für Fertigungstechnik und Maschinenbau Aktiengesellschaft, Steyr, Austria

[21] Appl. No.: 230,599

[22] Filed: Apr. 21, 1994

[30] Foreign Application Priority Data

Apr. 22, 1993 [AT] Austria ..... 790/93

[51] Int. Cl.[6] ..... B25J 9/14

[52] U.S. Cl. ..... 414/771; 414/728

[58] Field of Search ..... 414/771, 773, 778, 728; 901/24

[56] References Cited

U.S. PATENT DOCUMENTS

| | | | |
|---|---|---|---|
| 4,208,619 | 6/1980 | Delebecque et al. | 901/24 |
| 4,218,173 | 8/1980 | Coindet et al. | 901/24 |
| 4,458,566 | 7/1984 | Tajima | 414/728 |
| 4,714,400 | 12/1987 | Barnett et al. | 901/24 |
| 4,730,975 | 3/1988 | Mungkata | 901/24 |
| 5,098,458 | 3/1992 | Newkirk | 901/24 |

FOREIGN PATENT DOCUMENTS

| | | | |
|---|---|---|---|
| 1101329 | 3/1961 | Germany . | |
| 1300897 | 8/1969 | Germany . | |
| 1452015 | 10/1969 | Germany . | |
| 61-06312 | 11/1986 | WIPO | 901/24 |

*Primary Examiner*—Michael S. Huppert
*Assistant Examiner*—Thomas J. Brahan
*Attorney, Agent, or Firm*—Collard & Roe

[57] ABSTRACT

A simple, robust and rationally operable device for tilting rolled stock comprises a tilting head comprising a gripping device for the rolled stock, which defines a tilting axis, and a first drive for rotating the tilting head about a tilting head axis extending parallel to the tilting axis to adjust the tilting head in respective tilted positions. A lifting device supports the tilting head, and a second drive is arranged to raise and lower the lifting device to adjust the lifting device in respective lifting positions. A carriage supports the lifting device, and a third drive is arranged to displace the carriage transversely to the tilting axis to adjust the carriage in respective transverse positions. A numerical control is connected to the first, second and third drives and is arranged to receive control signal components respectively corresponding to the respective tilted, lifting and transverse positions to control the drives in response thereto to adjust the tilting of the rolled stock.

3 Claims, 3 Drawing Sheets

DEVICE FOR TILTING ROLLED STOCK

BACKGROUND OF THE INVENTION

1. Field of the Invention

The present invention relates to a device for tilting rolled stock, which comprises a tilting head comprising grippers for gripping the rolled stock, the grippers defining a tilting axis, a lifting device supporting the tilting head, and a carriage supporting the lifting device and displaceable transversely to the tilting axis.

2. Description of the Prior Art

Tilting devices are manipulators for rolled stock mounted in front, or rearwardly, of rolling mills to grip rolled stock, such as a rod or a billet, coming from the mill, to hold it, to tilt it about the axis of the rolled stock over a selected angle, to reverse it, to displace it laterally for the next pass through the mill, and to position it for introduction into the mill.

To enable these manipulations of the rolled stock to be effectuated, the tilting devices have tilting heads which are rotatable into adjusted positions and which are supported on a lifting device on a transversely displaceable carriage. The tilting heads usually have gripping means comprised of a pair of clamping rollers which may be driven towards each other and apart in opposite directions to grip the rolled stock therebetween and to release it. Since the rolled stock is to be tilted about its longitudinal axis, the gripping means for the rolled stock defines the tilting axis, i.e. the axis about which the rolled stock is tilted by the tilting head. In the known tilting devices, the tilting head is therefore mounted on the lifting device for rotation about this tilting axis, which requires very complicated support structures requiring a considerable amount of space, such as interacting pairs of rocking levers or the like which may be moved towards each other and apart. This support structure is mounted on the lifting device so that the tilting head may be lowered below the rolling axis and under the rolled stock while the transverse displacement of the carriage enables the lifting head to be transversely adjusted between rolling stock gages. This functionally separated arrangement of lifting device and transversely displaceable carriage for vertically adjusting and transversely displacing the tilting head, on the one hand, and the support structure for tilting the tilting head, on the other hand, increase the complexity of the construction and its space requirements even further. This results in a complicated operation of the device and tends to cause malfunctions.

Accepted German patent application No. 1,101,329 discloses a tilting device for rolled stock, which comprises tongs supported on a transversely displaceable carriage and pivotal 90° about an axis extending below the rolling plane. A ratchet-and-pinion drive connects the drive for transversely displacing the carriage and the pivoting drive for the tongs so that the tongs are pivoted simultaneously with the transverse displacement of the carriage to compensate for the transverse displacement of the axis of the rolled stock due to the pivoting of the tongs. Such a tilting device cannot tilt the rolled stock about its longitudinal axis, and the transverse carriage displacement used to compensate for the transverse rolled stock axis displacement can be adapted to different dimensions of the rolled stock only by changing the ratchet-and-pinion drive. This considerably reduces the usefulness of this tilting device.

SUMMARY OF THE INVENTION

It is the primary object of this invention to obviate the indicated disadvantages and to provide a tilting device for rolled stock of the first-described type, which has a relatively simple structure, enables the tilting head to be freely moved in various directions, and thus is useful for a large number of applications and marked by its compactness and functional dependability.

The above and other objects of the invention are accomplished with a device for tilting rolled stock, which comprises a tilting head comprising means for gripping the rolled stock, the gripping means defining a tilting axis, first drive means for rotating the tilting head about a tilting head axis extending parallel to the tilting axis to adjust the tilting head in respective tilted positions, a lifting device supporting the tilting head, second drive means for raising and lowering the lifting device to adjust the lifting device in respective lifting positions, a carriage supporting the lifting device, and third drive means for displacing the carriage transversely to the tilting axis to adjust the carriage in respective transverse positions. A numerical control is connected to the first, second and third drive means and arranged to receive control signal components respectively corresponding to the respective tilted, lifting and transverse positions to control the drives in response thereto to adjust the tilting of the rolled stock.

Because the tilting motion is split into three individual components, it is not necessary for the tilting head to execute its rotation about the tilting axis separately and relative to the lifting device and the transversely displaceable carriage, but this rotation is effectuated in combination with the lifting and transverse displacement motions. There is no need for complicated support structures, and it is sufficient to mount the tilting head at a suitable location spaced from the tilting axis and rotatable about a tilting head axis extending parallel thereto to orient the gripping means radially to the tilting axis when the head is tilted. The revolution of the tilting head axis about the tilting axis during the rotation of the tilting head is effected by superimposing the lifting and transverse displacement motion components of the lifting device and carriage. This requires only a suitably programmed numerical control for operating the three drive means. Since it is easy to split up the motions of the tilting head, the lifting device and the transversely displaceable carriage into respective motion components and to program the numerical control correspondingly, the required movements of the tilting device may be rationally effected. It is even possible to obtain special movements, such as elliptical or selected radially oriented motions, in addition to the usual pivoting of the tilting head, its up-and-down movement and transverse displacement. Since no complicated support structure is required for the tilting head, and the tilting head, lifting device and transversely displaceable carriage are operated together, the construction of the tilting device is relatively simple, the device can be viewed from all sides, it functions very dependably, and is compact and robust.

According to a preferred embodiment, the tilting device further comprises respective transmitters of the control signal components, the transmitters picking up the respective positions and transmitting the corresponding control signal components to the control. The transmitters are preferably a rotary encoder. By reading the existing positions of the tilting head, the lifting device and the transversely displaceable carriage, it is possible not only to control the tilting device motions in a desired manner but to use one of the existing positions, preferably that of the tilting head, as the reference value for controlling the two other drive means, which permits the numerical control to be provided with different programs.

The lifting device may take any suitable form. It could be, for example, a support frame linked to pivotal arms, or an elevator platform supported on scissors levers. According to a preferred feature of the present invention, however, the transversely displaceable carriage comprises a rectilinear guide for the lifting device, and the lifting device is an elevator carriage supporting the tilting head. The guides for the elevator carriage and the transversely displaceable carriage provide simple coordinate devices for splitting up the motion components of the tilting device movement. The paths of the two carriages intersect, which permits the direct determination of any point in a plane defined by the guides within the range of the carriage movements.

BRIEF DESCRIPTION OF THE DRAWING

The above and other objects, advantages and features of this invention will become more apparent from the following detailed description of a now preferred embodiment thereof, taken in conjunction with the accompanying schematic drawing wherein.

DETAILED DESCRIPTION OF PREFERRED EMBODIMENT

Figure 1:
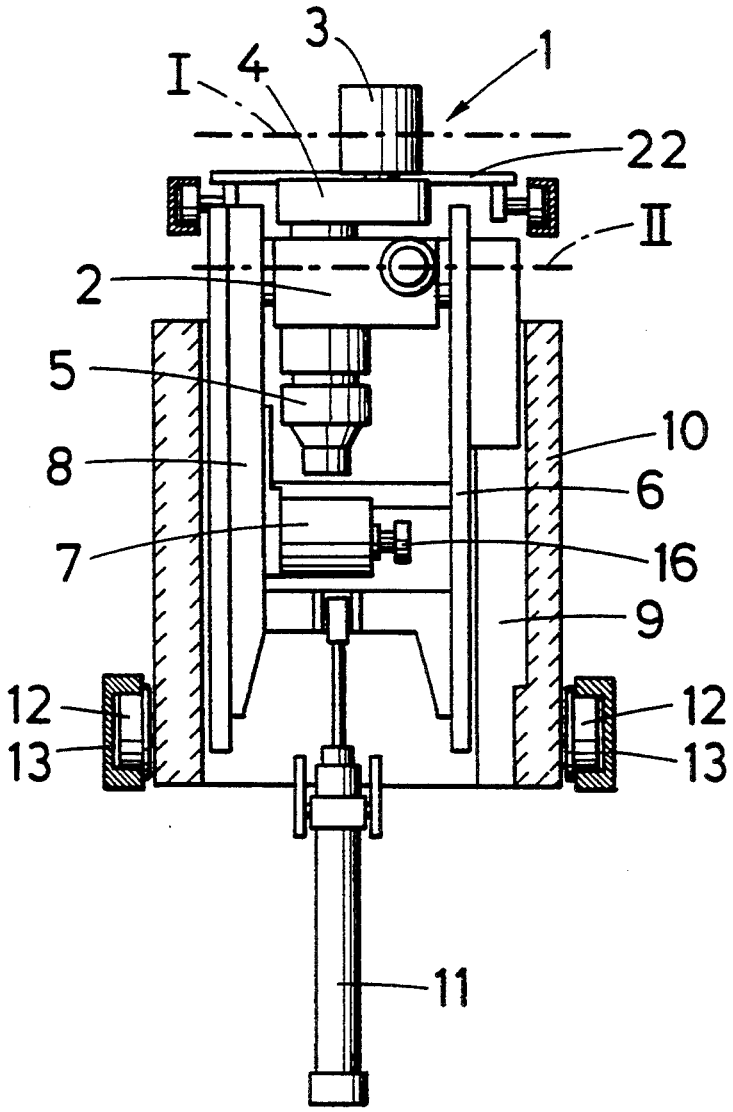
FIG. 1 is an end view, partly in section, of a tilting device according to the invention.
Figure 2:
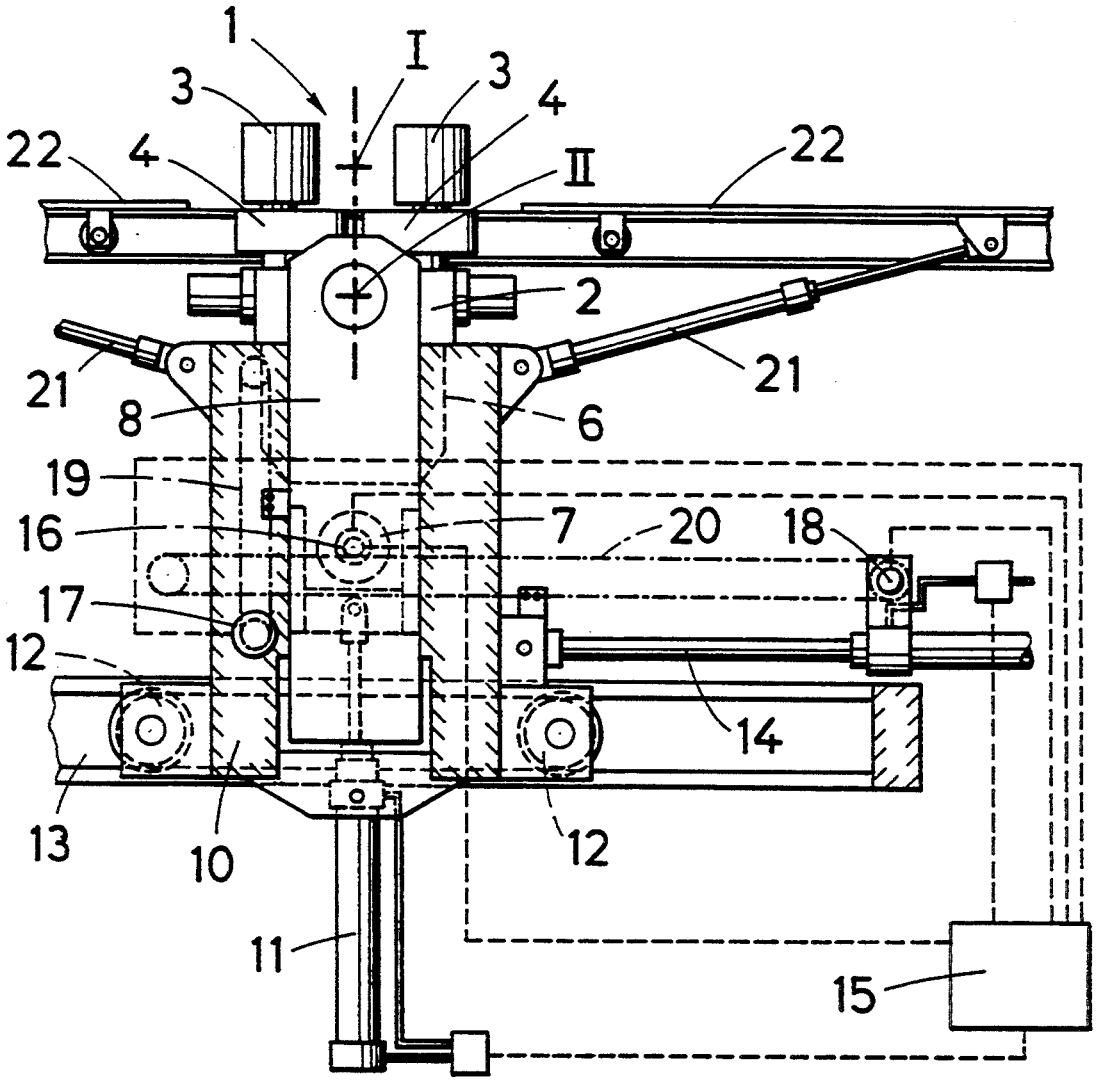
FIG. 2 is a side elevational view, partly in section, of the tilting device of FIG. 1.

Referring now to the drawing, there is shown device 1 for tilting rolled stock W. Tilting device 1 comprises tilting head 2 comprising means for gripping rolled stock W, the gripping means defining tilting axis I. The illustrated gripping means comprises two clamping rollers 3 mounted on pivotal arms 4 which may be swung towards each other and apart to clamp the rolled stock therebetween and to open the pair of clamping rollers for release of the rolled stock. Reversible hydraulic motor 5 actuates the closing and opening movements of the pivotal arms carrying the clamping rollers.

Tilting head 2 is supported on lifting device 6 for rotating the tilting head about a tilting head axis II extending parallel to tilting axis I to adjust the tilting head in respective tilted positions, and a first drive means comprising pivoting motor 7 and transmission gearing 8 is provided for rotating tilting head 2 through at least 180°. Illustrated lifting device 6 supporting tilting head 2 is an elevator carriage displaceable in vertically extending rectilinear guide 9 of transversely displaceable carriage 10. Second drive means 11 comprised of a hydraulic cylinder-and-piston jack is connected to elevator carriage 6 for raising and lowering the same to adjust it in respective lifting positions. Carriage 10 supports lifting device 6, and third drive means 14, also comprised of a hydraulic cylinder-and-piston jack, is connected to carriage 10 for displacing the carriage transversely to tilting axis I to adjust carriage 10 in respective transverse positions. The transversely displaceable carriage runs on rollers 12 engaging a horizontally extending rectilinear guide of guide frame 13.

Numerical control 15 is connected by respective control signal transmission lines (indicated in phantom lines) to first, second and third drive means 7, 11 and 12 respectively operating tilting head 2, lifting device 6 and transversely displaceable carriage 10. The numerical control has incorporated therein a suitable computer program which permits splitting up each tilting motion of clamping rollers 3 relative to tilting axis I into three motion components, i.e. the movement about tilting head axis II, the vertical movement along guide 9 and the transverse movement along the horizontal guide of guide frame 13. Numerical control 15 is arranged to receive control signal components respectively corresponding to the respective tilted, lifting and transverse positions to control drives 7, 11 and 14 in response thereto to adjust the tilting of rolled stock W. The superimposition of the three motion components enables the tilting of clamping rollers 3 to be performed exactly.

Preferably, as shown, the existing positions of tilting head 2, vertically displaceable lifting device 6 and horizontally displaceable carriage 10 are read, respectively, by transmitters 16, 17 and 18 of the respective control signal components, the transmitters picking up the respective positions and transmitting the corresponding control signal components to the control. Rotary encoders are preferably used as control signal transmitters. Signal transmitter 16 is mounted on pivoting motor 7 while signal transmitters 17 and 18 are coupled to carriages 6 and 10 by ratchet drives or the illustrated belt drives 19, 20 to read the vertical and horizontal displacements of these carriages. The existing positions generate corresponding control signals transmitted to numerical control 15 so that the control of drive means 7, 11, 14 of tilting head 2, elevator carriage 6 and transversely displaceable carriage 10 may be coordinated exactly to obtain the desired motions of the tilting device.

As shown, cover carriages 22 are connected to tilting device 1 by adjustment drives 21 and are movable parallel to carriage 10 so that the area occupied by the tilting device may be covered with respect to the rolled stock when the tilting head is in its lowered position.

As will be noted from FIGS. 3 to 6, the tilting movements of tilting device 1 can be controlled in three components by numerical control 15 by individually actuating drive means 7 for tilting head 2, drive means 11 for lifting device 6 and drive means 14 for transversely displaceable carriage 10. This makes a very simple construction and rational operation of the tilting device possible.

Figure 3:
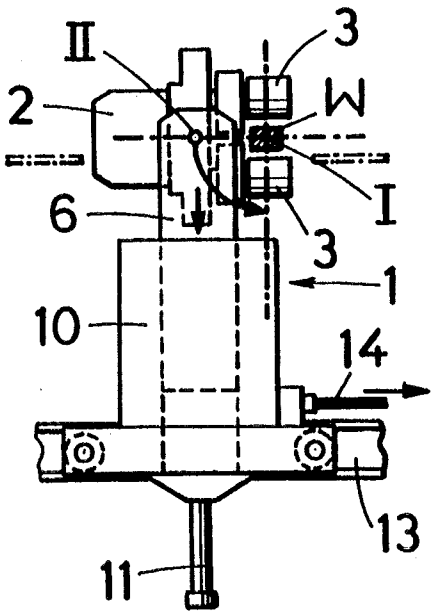

FIG. 3 shows tilting device 1 in its normal gripping position. Tilting head 2 has been turned 90° clockwise from its centered position, in which clamping rollers 3 are oriented upwardly, to a position in which the clamping rollers are positioned laterally adjacent rolled stock W. The clamping rollers facing tilting axis I are opened so that rolled stock W can move between the clamping rollers and may be gripped by closing the clamping rollers.

Figure 5:
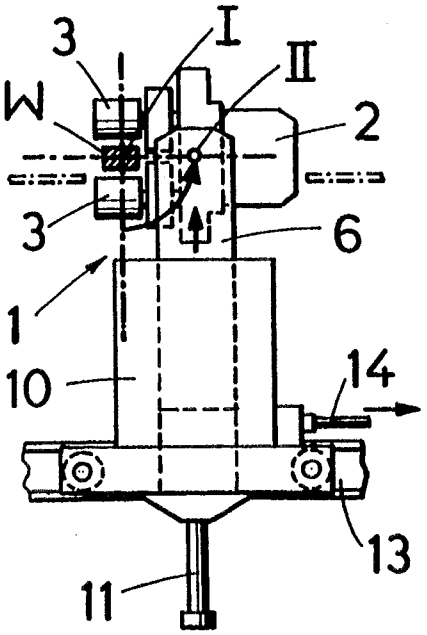
Figure 4:
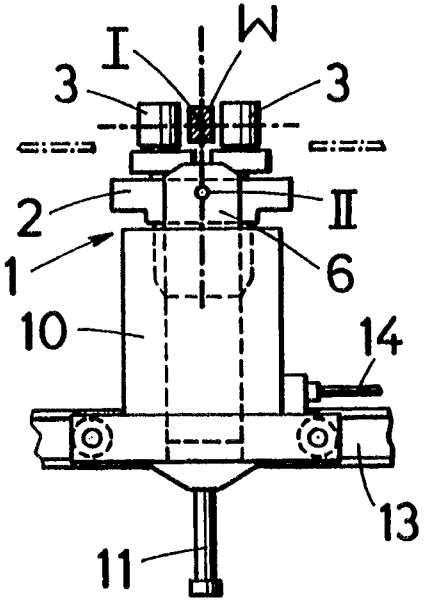

As shown in FIG. 4, drive 4 is now actuated to lower elevator carriage 6, drive 14 is actuated to displace carriage 10 transversely and motor 7 is actuated to pivot the tilting head 90° counterclockwise to turn the rolled stock 90° to assume the centered position shown in this figure. If transversely displaceable carriage 10 is further moved in the same direction but elevator carriage 6 is raised and tilting head 2 is further turned 90° counterclockwise, a 90° counterclockwise turn from the centered position is obtained, i.e. a total turn of 180° of clamping rollers 3 about tilting axis I and thus a 180° tilt of rolled stock W, as shown in FIG. 5.

Figure 6:
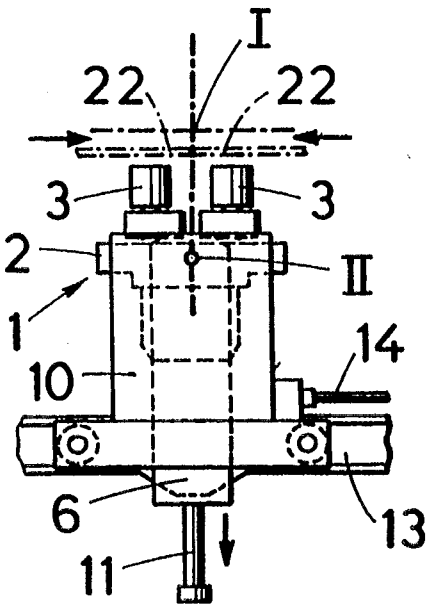
FIGS. 3 to 6 show the tilting device in different operating positions, on a reduced scale.

FIG. 6 illustrates tilting head 2 in the centered position but elevator carriage 6 in its lowermost position so that, with closed cover carriages 22, tilting head 2 with clamping rollers 3 can be located below the rolled stock, which makes a gripping of rolled stock W from two opposite sides possible.

Obviously, the range of motions of tilting device 1 is not limited to the positions illustrated in FIGS. 3–6 but any composite movement can be readily produced, which is comprised of the motion component of the circular movement of idling head 2 about tilting head axis II, the motion component of the vertical movement of lifting device 6 along rectilinear guide 9, and the motion component of the horizontal movement of transversely displaceable carriage 10 along the rectilinear guide of guide frame 13.

What is claimed is:

1. A device for tilting rolled stock, which comprises (a) a tilting head comprising (1) means for gripping the rolled stock, the gripping means defining a tilting axis, (b) first drive means for rotating the tilting head about a tilting head axis extending parallel to the tilting axis to adjust the tilting head in respective tilted positions, (c) a lifting device supporting the tilting head, the lifting device being an elevator carriage supporting the tilting head, (d) second drive means for raising and lowering the lifting device to adjust the lifting device in respective lifting positions, (e) a carriage supporting the lifting device, the carriage comprising (1) a rectilinear guide for the lifting device, (f) third drive means for displacing the carriage transversely to the tilting axis to adjust the carriage in respective transverse positions, and (g) a numerical control connected to the first, second and third drive means and arranged to receive control signal components respectively corresponding to the respective tilted, lifting and transverse positions to control the drive means so that the rolled stock substantially remains in the same horizontal plane and the same vertical plane as it is tilted.

2. The tilting device of claim 1, further comprising respective transmitters of the control signal components, the transmitters picking up the respective positions and transmitting the corresponding control signal components to the control.

3. The tilting device of claim 2, wherein the transmitters are rotary encoders.

* * * * *